US012378775B2

(12) United States Patent
Hannig et al.

(10) Patent No.: US 12,378,775 B2
(45) Date of Patent: Aug. 5, 2025

(54) PANEL

(71) Applicant: Surface Technologies GmbH & Co. KG, Baruth (DE)

(72) Inventors: Hans-Jürgen Hannig, Bergisch Gladbach (DE); Carsten Buhlmann, Rangsdorf (DE); Andreas Sieder, Ludwigsfelde (DE); Eberhard Herrmann, Wismar (DE)

(73) Assignee: SURFACE TECHNOLOGIES GMBH & CO. KG, Baruth (DE)

( * ) Notice: Subject to any disclaimer, the term of this patent is extended or adjusted under 35 U.S.C. 154(b) by 9 days.

(21) Appl. No.: 17/761,407

(22) PCT Filed: Sep. 17, 2021

(86) PCT No.: PCT/EP2021/075602
§ 371 (c)(1),
(2) Date: Mar. 17, 2022

(87) PCT Pub. No.: WO2022/058489
PCT Pub. Date: Mar. 24, 2022

(65) Prior Publication Data

US 2022/0356716 A1 Nov. 10, 2022

(30) Foreign Application Priority Data

Sep. 17, 2020 (EP) ..... 20196642

(51) Int. Cl.
*E04F 13/08* (2006.01)
*E04F 15/02* (2006.01)

(52) U.S. Cl.
CPC .... *E04F 13/0894* (2013.01); *E04F 15/02038* (2013.01); *E04F 2201/043* (2013.01)

(58) Field of Classification Search
CPC ..... E04F 13/0894; E04F 15/02038; E04F 2201/043; E04F 15/102; E04F 2201/0153;
(Continued)

(56) References Cited

U.S. PATENT DOCUMENTS 7,584,583 B2 * 9/2009 Bergelin ..... E04C 2/24 52/177
7,866,110 B2 1/2011 Pervan
(Continued)

FOREIGN PATENT DOCUMENTS

CN 201671292 U 12/2010
DE 202019101807 U1 5/2019
(Continued)

OTHER PUBLICATIONS

English translation of Russian Patent Office issued Office Action and Search Report dated Dec. 26, 2022 1 regarding parallel Russian Patent Application No. 2022120604/03, 12 pages.
(Continued)

*Primary Examiner* — Gisele D Ford
(74) *Attorney, Agent, or Firm* — LUCAS & MERCANTI, LLP; Klaus P. Stoffel

(57) ABSTRACT

A panel including a core, a top side, an underside, a first edge pair and a second edge pair. The first edge pair has a groove profile at a panel edge and a complementary tongue profile at the opposite panel edge, which are lockable by a pivotal movement and positively lock so that movement of locked panels away from each other in the plane of the panels is opposed. At its opposite panel edges the second edge pair has a complementary receiving hook and an arresting hook. The arresting hook is assembled to the receiving hook by a joining movement in a plane perpendicular to the panel plane by the pivotal movement for the first edge pair. The receiving hook or the arresting hook has a holding groove
(Continued)

for a separate locking element that provides vertical locking. A butting surface is arranged at the receiving hook substantially orthogonal to the top side. The arresting hook has a counterpart butting surface substantially orthogonal to the top side. The second edge pair has at least one sealing nose at a lower end of the counterpart butting surface of the arresting hook or at a lower end of the butting surface of the receiving hook. The sealing nose extends parallel to the respective panel edge over the entire length of the counterpart butting surface or the butting surface.

10 Claims, 6 Drawing Sheets

(58) Field of Classification Search
CPC ..... E04F 2201/03; E04F 2201/023; F16B 5/0012; F16B 5/008
See application file for complete search history.

(56) References Cited

U.S. PATENT DOCUMENTS 8,596,013 B2 * 12/2013 Boo ..... E04F 13/076 52/588.1
8,966,853 B2 3/2015 Hannig
9,347,469 B2 5/2016 Pervan
9,422,727 B2 * 8/2016 Sjoberg ..... E04F 15/02011
9,453,347 B2 9/2016 Pervan
9,765,530 B2 9/2017 Bergelin
11,359,381 B2 * 6/2022 Sieder ..... E04F 15/02033
11,608,646 B2 * 3/2023 Schäfers ..... E04F 15/102
2004/0123547 A1 * 7/2004 Grafenauer ..... E04F 15/02 52/592.1
2005/0166514 A1 * 8/2005 Pervan ..... B27M 3/04 52/578
2006/0260254 A1 * 11/2006 Pervan ..... E04F 15/04 52/592.1
2008/0104921 A1 * 5/2008 Pervan ..... E04F 15/107 52/588.1
2008/0134614 A1 * 6/2008 Pervan ..... E04F 21/22 52/391
2008/0236088 A1 * 10/2008 Hannig ..... F16B 5/0056 52/592.1
2008/0241440 A1 * 10/2008 Bauer ..... E04F 15/02 428/33
2009/0064624 A1 * 3/2009 Sokol ..... E04F 15/02 52/591.5
2009/0193748 A1 * 8/2009 Boo ..... B27F 1/02 408/1 R
2009/0320402 A1 12/2009 Schacht
2010/0037550 A1 2/2010 Braun
2010/0043333 A1 2/2010 Hannig
2010/0058702 A1 3/2010 Lei
2010/0313511 A1 * 12/2010 Thiers ..... E04F 15/02033 52/506.01
2011/0030303 A1 * 2/2011 Pervan ..... B27F 1/08 83/13
2011/0138722 A1 * 6/2011 Hannig ..... E04F 15/02033 52/309.1
2011/0173914 A1 * 7/2011 Engstrom ..... E04F 15/02038 52/582.2
2011/0271632 A1 * 11/2011 Cappelle ..... E04F 15/02 52/582.2
2012/0055112 A1 * 3/2012 Engstrom ..... E04F 15/02144 52/582.2
2012/0066996 A1 * 3/2012 Konstanczak ..... E04F 13/08 52/588.1
2012/0096801 A1 * 4/2012 Cappelle ..... E04F 15/02038 52/592.1
2012/0124932 A1 * 5/2012 Schulte ..... E04F 15/02 52/588.1
2012/0174519 A1 * 7/2012 Schulte ..... E04F 13/08 29/428
2012/0266555 A1 * 10/2012 Cappelle ..... E04F 15/02194 52/309.1
2012/0317916 A1 * 12/2012 Oh ..... E04F 15/02 52/588.1
2013/0008118 A1 * 1/2013 Baert ..... E04F 15/02016 156/60
2013/0008119 A1 * 1/2013 Vermeulen ..... E04B 5/023 52/582.2
2013/0014463 A1 * 1/2013 Pervan ..... E04F 15/107 52/582.2
2013/0025231 A1 * 1/2013 Vermeulen ..... E04F 15/02038 403/327
2013/0036695 A1 2/2013 Durnberger
2013/0042562 A1 * 2/2013 Pervan ..... E04F 13/0894 52/582.2
2013/0042564 A1 * 2/2013 Pervan ..... E04F 15/02038 52/582.2
2013/0042565 A1 * 2/2013 Pervan ..... E04F 15/02038 52/588.1
2013/0047536 A1 * 2/2013 Pervan ..... E04F 15/105 52/309.1
2013/0104486 A1 * 5/2013 Windmoller ..... E04F 15/107 29/428
2013/0276398 A1 * 10/2013 Hannig ..... C10L 11/04 52/588.1
2014/0242342 A1 * 8/2014 Vandevoorde ..... B32B 29/005 428/192
2014/0283466 A1 * 9/2014 Boo ..... E04F 15/02038 52/309.1
2014/0366476 A1 12/2014 Pervan
2015/0000221 A1 * 1/2015 Boo ..... E04F 15/02038 52/588.1
2015/0218812 A1 * 8/2015 Kell ..... E04F 13/0894 428/99
2015/0240500 A1 * 8/2015 Stevens, Jr. ..... E04F 15/105 52/588.1
2015/0252573 A1 * 9/2015 Devos ..... E04F 15/02 52/582.2
2015/0300029 A1 * 10/2015 Pervan ..... E04F 15/02038 52/582.2
2015/0330088 A1 * 11/2015 Derelov ..... E04F 15/02038 52/588.1
2015/0337540 A1 * 11/2015 Cappelle ..... E04F 15/105 52/309.1
2016/0153200 A1 * 6/2016 Pervan ..... E04F 15/102 52/582.2
2017/0067261 A1 * 3/2017 Hannig ..... E04F 15/02038
2017/0370109 A1 * 12/2017 Devos ..... E04F 15/02038
2018/0002933 A1 1/2018 Pervan
2018/0010342 A1 * 1/2018 Van Hooydonck ... E04F 15/105
2018/0094441 A1 * 4/2018 Boo ..... E04F 15/02033
2018/0119429 A1 * 5/2018 Schulte ..... E04F 15/02038
2018/0155934 A1 * 6/2018 D'Hondt ..... B27N 7/00
2018/0195291 A1 * 7/2018 Loncke ..... B32B 21/14
2018/0216353 A1 8/2018 Hannig
2018/0274246 A1 * 9/2018 Vandevoorde .... E04F 15/02033
2019/0024388 A1 * 1/2019 Devos ..... E04F 15/105
2019/0136545 A1 * 5/2019 De Rick ..... E04F 15/107
2020/0063443 A1 * 2/2020 Boucké ..... E04F 15/02038
2020/0087926 A1 * 3/2020 Loebel ..... E04B 1/6179
2020/0123788 A1 * 4/2020 Baert ..... B32B 13/14
2020/0318360 A1 * 10/2020 De Rick ..... E04F 15/02038
2021/0002907 A1 * 1/2021 Boucké ..... E04F 15/107
2021/0087829 A1 * 3/2021 Ylikangas ..... B27M 3/06
2021/0087831 A1 * 3/2021 Nilsson ..... E04F 15/105
2021/0238863 A1 8/2021 Sieder
2021/0254349 A1 8/2021 Schäfers
2021/0355688 A1 * 11/2021 Boo ..... E04F 15/02038
2022/0112728 A1 * 4/2022 Perra ..... E04F 15/02038
2022/0298802 A1 * 9/2022 Ylikangas ..... E04F 15/02038
2022/0341187 A1 * 10/2022 De Rick ..... E04F 15/02038
2023/0016968 A1 * 1/2023 Devos ..... E04F 15/02038

(56) References Cited

U.S. PATENT DOCUMENTS

| | | | | |
|---|---|---|---|---|
| 2023/0090055 | A1* | 3/2023 | Bladh | E04F 15/02038 |
| 2023/0228100 | A1* | 7/2023 | De Rick | B27F 1/02 52/588.1 |

FOREIGN PATENT DOCUMENTS

| | | | |
|---|---|---|---|
| EP | 1415056 | B1 | 1/2006 |
| RU | 2415235 | C2 | 2/2010 |
| WO | 2011087425 | A1 | 7/2011 |
| WO | 2019238811 | A1 | 12/2019 |

OTHER PUBLICATIONS

English translation of Chinese Patent Office issued Office Action and Search Report dated Feb. 9, 2023 regarding parallel Chinese Patent Application No. 202180005291.1, 12 pages.
Canadian Office Action dated Oct. 19, 2023 regarding parallel Canadian Patent Application No. 3,169,835, 8 pages.

* cited by examiner

FIG 10
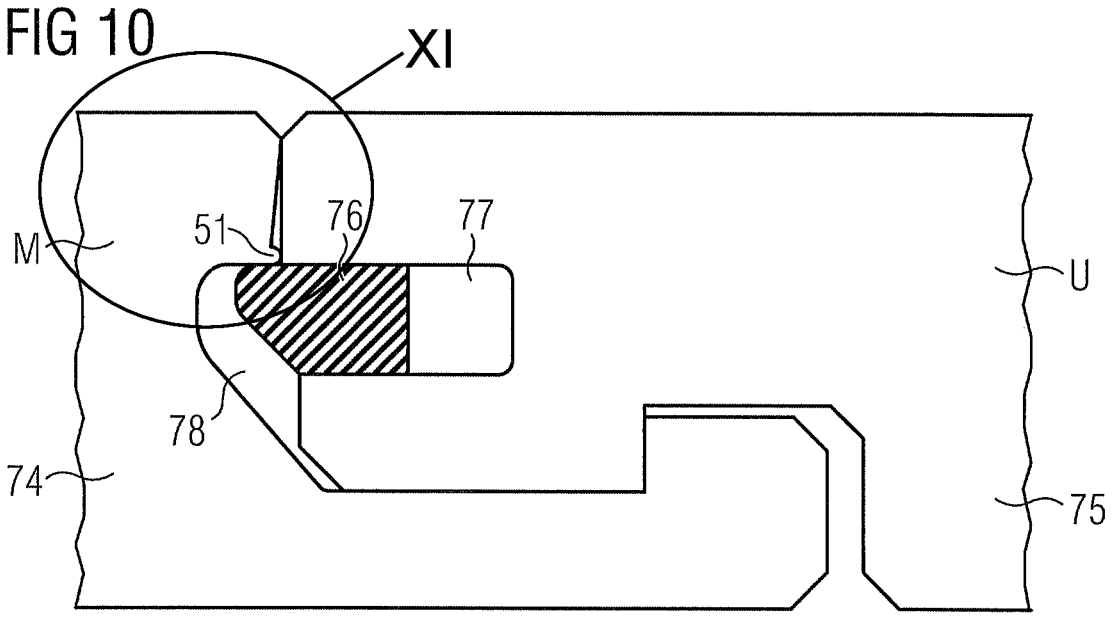
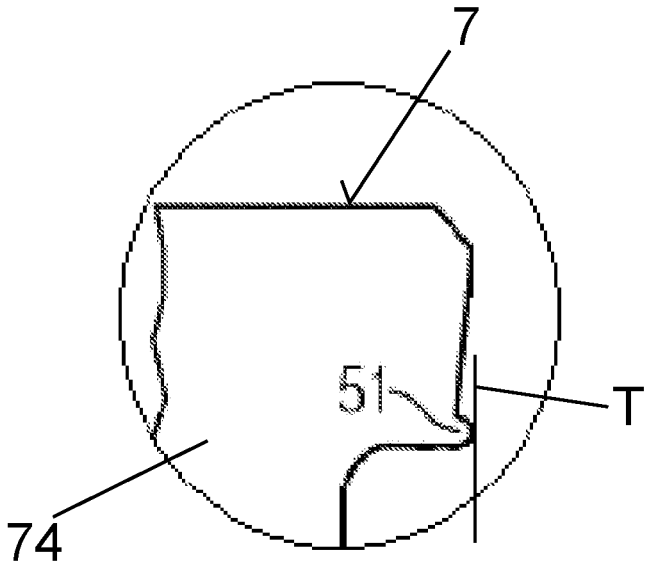
Fig. 11

PANEL

CROSS-REFERENCE TO RELATED APPLICATIONS

The present application is a 371 of International application PCT/EP2021/075602, filed Sep. 17, 2021, which claims priority of EP 20196642.1, filed Sep. 17, 2020, the priority of these applications is hereby claimed and these applications are incorporated herein by reference.

BACKGROUND OF THE INVENTION

The invention concerns a panel comprising a panel core, a panel top side, a panel underside and a first edge pair and a second edge pair, wherein the first edge pair is provided with a groove profile at a panel edge and a tongue profile complementary thereto at the opposite panel edge, which are lockable by a pivotal movement and then cooperate in positively locking relationship in such a way that in the locked state a vertical locking action can be achieved and movement of locked panels away from each other in the plane of the panels (horizontally) is opposed, wherein at its opposite panel edges the second edge pair is provided with complementary hook profiles, namely a receiving hook and an arresting hook, wherein the arresting hook can be assembled to the receiving hook by a joining movement in a plane perpendicular to the panel plane simultaneously by means of the pivotal movement for the first edge pair, with the proviso that the receiving hook is provided with a holding groove for a separate locking element with which a vertical locking action can be achieved.

A panel of the general kind set forth is known from EP 1 415 056 B1. This is a panel which includes a first edge pair with a tongue-and-groove profile and a second edge pair with hook profiles. In that way the known panel can be locked at an edge with the tongue profile to the groove profile of the panels of a preceding row of panels by means of a pivotal movement. It is viewed as a great advantage that one of the edges with the hook profile can also be locked at the same time by means of the above-mentioned pivotal movement. In that situation the separate locking element latches of its own accord. The latching function of the locking element is automatically triggered by the above-mentioned pivotal movement at the first edge pair of the panel.

That panel laying mode is also referred to as fold-down laying or the appropriate panel is referred to as a fold-down panel.

Panels of that kind are connected together in rows, in which case there are transverse joins between the panels within a row. In addition longitudinal joins are respectively formed between the rows of panels of a laid surface coverage which is formed in combined relationship in that way. It is desirable that the longitudinal joins and transverse joins of such a coverage surface are to afford a certain degree of sealing integrity to prevent water from passing therethrough. In practice it has unfortunately been found that water can penetrate into joins and in places can flow from the panel top side through the join to the panel underside. Water which penetrates into the join or passes therethrough in that way can lead to the formation of mold which can spread concealed under the surface coverage. It has been found in that case that moisture can penetrate or pass through in particular by way of the transverse edge and the intersections of transverse and longitudinal edges.

SUMMARY OF THE INVENTION

The object of the invention is to propose a panel which is of an improved configuration at least in respect of the profiles of the second edge pair in order better to resist water passing through at the joins.

According to the invention that object is attained in that a butting surface is arranged at the receiving hook substantially orthogonally relative to the panel top side, that a counterpart butting surface is arranged at the arresting hook substantially orthogonally relative to the panel top side, that there is provided a sealing nose at the second edge pair at a lower end of the counterpart butting surface of the arresting hook or at a lower end of the butting surface of the receiving hook, which sealing nose extends parallel to the respective panel edge over the entire length of the counterpart butting surface or the butting surface.

The sealing nose projects at the panel edge in a distal direction from the butting surface of the receiving hook or in a distal direction from the counterpart butting surface of the arresting hook. The cross-section of the sealing nose desirably has an external contour composed of combined rounded and/or curved portions. A distal end of the curved or rounded sealing nose has a turning point or a turning point tangent. The turning point tangent is arranged relative to the panel top side at an angle between ≥30° and ≤90°, preferably ≥45° and ≤90°, in particular ≥60° and ≤90°. Preferably the turning point tangent is at the turning point which is distally at the maximum distance from the panel core.

The proposed panel is provided with a sealing measure which is spatially arranged physically in the region below the recessed joins and above the operative location for the vertical locking action. More specifically the sealing nose which is provided at the counterpart butting surface and which in the locked state cooperates with the butting surface affords a sealing action. The sealing effect can be achieved by pressing of the sealing nose against the butting surface and/or when moisture is present by swelling of the sealing nose because it then increases in size at the latest due to the swelling effect and comes into sealing contact with the butting surface.

A further measure which contributes to the sealing effect can be achieved if at least one of the edge pairs at the two complementary panel edges thereof has a respective edge break which in the assembled state of two of said panels constitutes a recessed join.

Desirably the edge breaks of at least one of the edge pairs of the complementary panel edges are provided respectively with a larger edge break and a smaller edge break, wherein in the assembled state the larger edge break is covered over by the smaller edge break.

The cross-section of the holding groove can easily be retained for the separate locking element and a known locking element can be used. Suitable locking elements are known for example from EP 1 415 056 B1, WO 2011/087425 A1, U.S. Pat. No. 9,347,469 B2 or U.S. Pat. No. 7,866,110 B2. Reference is hereby made to the examples of design configurations for separate locking elements and the arrangement thereof on a panel, as defined in the above-mentioned publications, and that technical teaching is incorporated herein. The separate locking element for the complementary hook profiles can optionally be provided as a constituent part of the panel. It is preferably then pre-fitted in the holding groove of the receiving hook.

The proposed panel is of a quadrangular basic shape. At one of the four corners of the panel the tongue profile of the first edge pair comes together with the receiving hook of the second edge pair. Those two differing forms of the panel edges overlap in that corner whereby this results in an overlap zone in respect of the different profile shapes, in which there is a complex three-dimensional configuration. The complex configuration therefore means that the receiving hook must have the holding groove for the locking element and for that reason that holding groove comes together at the corner with the tongue profile of the adjoining panel edge of that corner. To manufacture the holding groove material of the panel core has to be removed, for example by milling. The milling of the holding groove passes through the tongue profile at an end (transitional zone) and machines a part of the panel core, that formed the tongue. A part of the material of the tongue profile is therefore machined and removed. A gap is produced at the tongue top side in that transitional zone, and no water may pass through to that gap. For that reason the proposed design configuration pursues the technical path of providing above the tongue top side suitable measures which effectively resist the ingress of water as far as the level of the tongue top side. It has been found that it is possible to achieve better sealing integrity in relation to water passing therethrough in that way.

The complementary hook profiles of the second edge pair, namely the upwardly open receiving hook and the downwardly open arresting hook, advantageously integrally have on both sides holding surfaces provided on the panel core, by means of which the locking action can be achieved to prevent the panels from moving away from each other within the panel plane in a direction perpendicular to the locked panel edges. The locking action in the vertical direction which is perpendicular to the panel top side is especially user-friendly and can be easily achieved by means of the separate locking element.

Advantageously the carrier plate forming the basis of a panel according to the invention has a fiber material like for example a high-density fiber material (HDF) or a medium-density fiber material (MDF), an oriented strand board (OSB) or a wood-plastic composite material (WPC). It can also be provided that the panel has a decoration, in which case that decoration can be provided either by applying a decorative layer which has already been printed to a carrier plate or by direct printing of the carrier plate with such a decoration. In that respect in the present case the term direct printing is also used to mean printing of a printing background previously applied to a carrier plate. It can also be provided that the panel comprises a full wood material or is formed completely from a wood material. Advantageously such a fiber material can absorb water or liquid in the case of coming into contact with moisture, and that leads to swelling. In that case such swelling leads to an improved sealing closure in the region of the sealing nose or the butting surface and the counterpart butting surface. In a further embodiment of the invention the carrier plate forming the basis for a panel according to the invention has a plastic material like for example a polypropylene (PP), polyethylene (PE), polyethylene-terephthalate (PET), an acrylonitrile-butadiene-styrene-copolymer (ABS), a polyvinyl chloride (PVC), a polycarbonate (PC), a polyamide (PA), a polyetherketone (PEK), polyetheretherketone (PEEK), mixtures or copolymers thereof, or a plastic composite material comprising one or more of said plastics with a fiber and/or mineral filler.

In addition it is possible to achieve an improvement in the sealing integrity by the provision at each panel edge having the smaller edge break of a projection, on the top side of which there extends at least a part of the smaller edge break, while provided at an underside of the projection is an undercut counterpart surface for the covered-over part of the larger edge break.

It is desirable that the smaller edge break of the first edge pair is arranged at the groove profile and the larger edge break is arranged at the tongue profile and that the smaller edge break of the second edge pair is arranged at the arresting hook and the larger edge break is arranged at the receiving hook.

Furthermore it is helpful in terms of improving the sealing integrity if arranged at the receiving hook beneath the large edge break the counterpart surface is arranged orthogonally relative to the panel top side, wherein the counterpart butting surface on the arresting hook is inclined relative to the orthogonal on the panel top side through an angle in the range of 1°-5° and the cross-section of the arresting hook in the inclined region of the counterpart butting surface has an oversize so that in the locked state a pressing action can be caused between the counterpart butting surface and the butting surface. The term "oversize" relates to the relationship of the two panel edges which can be assembled together. Starting from a theoretical nominal dimension of the two panel edges the term "oversize" is used to mean that, starting from the nominal size, more material is present either at the butting surface and/or at the counterpart butting surface so that the surface of the butting surface and/or the surface of the counterpart butting surface projects distally further than the nominal dimension. In practice this can be a maximum oversize by hundredths to a few tenths of a millimeter, which in practice produces the desired pressing action between the butting surface and the counterpart butting surface of the assembled panel edges. That desired pressing effect appropriately occurs in the upper region of the butting surface and the counterpart butting surface and can extend for example over half the height of the butting surface or counterpart butting surface.

In that way there are three possible measures which resist ingress of water into the join or resist the flow of water to the panel underside. Upmost the coverage of the large edge break by the small edge break affords a sealing effect. Below that there is the oversize of the counterpart butting surface which produces a pressing action against the butting surface, that has a sealing action.

Lowermost is the sealing nose which in the locked state provides for sealing integrity together with the butting surface.

An advantageous development provides that the pressing action between the counterpart butting surface and the butting surface is greater at the upper end of the butting surface and decreases towards the lower end of the butting surface.

The benefit can be further improved if arranged at the lower end of the pressing action between the counterpart butting surface and the butting surface is the sealing nose with which once again an increased pressing action against the butting surface can be created in the locked state.

To provide a closed join it is useful if the separate locking element has a latching means, with which it can automatically latch into a latching recess in the complementary panel edge.

An alternative provides that the holding groove for the separate locking elements has parallel groove walls.

Desirably the groove walls of the holding groove are at a constant spacing from each other.

It is further helpful if the holding groove or the groove walls thereof are arranged inclinedly relative to the panel top side.

Furthermore it is useful if the free opening of the inclinedly arranged holding groove is directed upwardly, that is to say in the direction of the panel top side.

BRIEF DESCRIPTION OF THE DRAWING

The invention is described in detail hereinafter by means of a number of embodiments and illustrated by way of example in a drawing in which:

FIG. 10 shows a last example of a cross-section through the second edge pair of the panel according to the invention in the locked state, and FIG. 11 shows a portion on an enlarged scale as indicated at XI in FIG. 10.

DETAILED DESCRIPTION OF THE INVENTION

Figure 1:
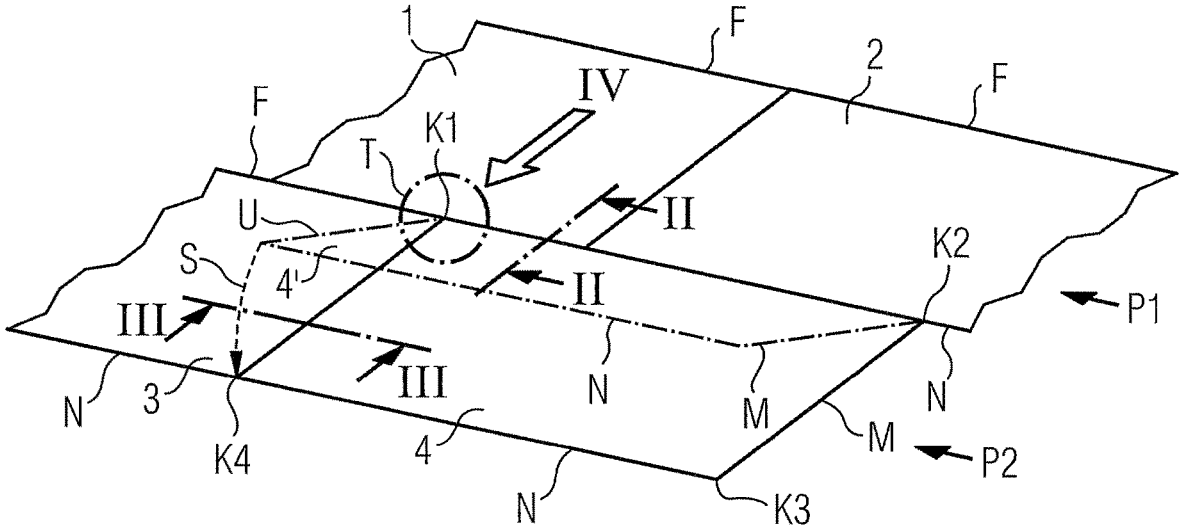
FIG. 1 shows a diagrammatic view of a plurality of panels according to the invention in combination.
Figure 2:
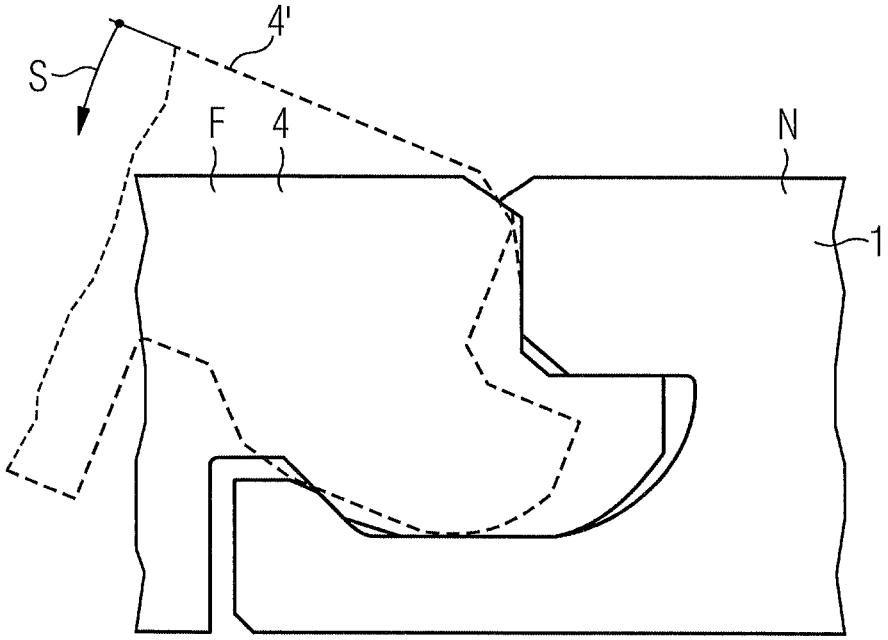
FIG. 2 shows by way of example a cross-section through a first edge pair of a panel according to the invention in the locked state.
Figure 3:
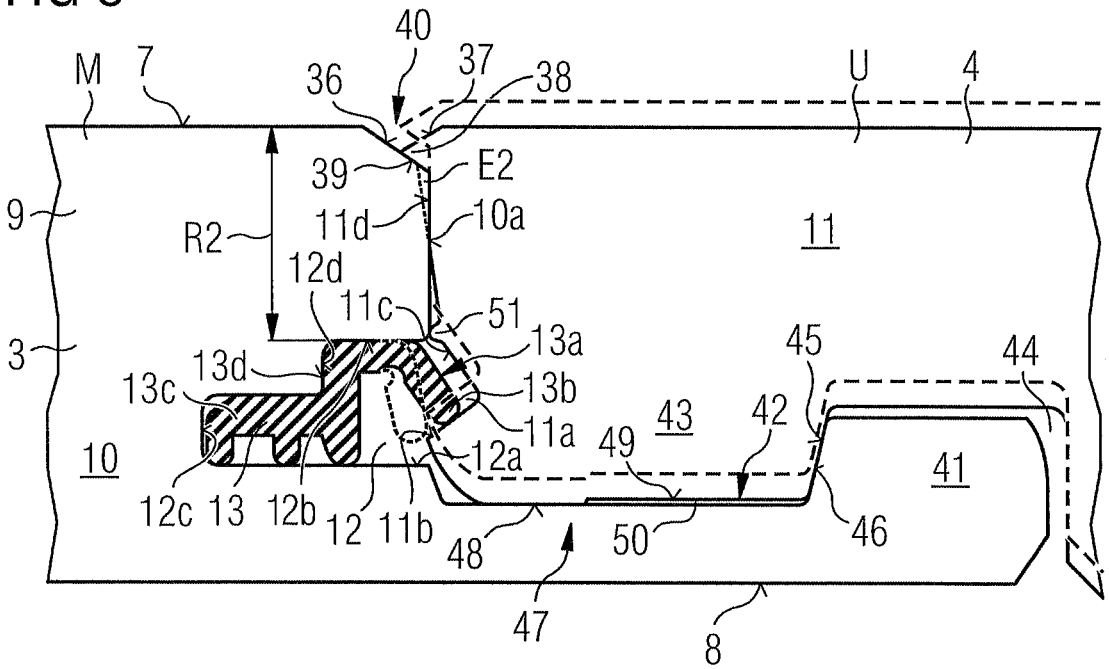
FIG. 3 shows a cross-section through the second edge pair of the panel according to the invention in the locked state.

FIG. 1 diagrammatically shows portions of four identical panels 1, 2, 3 and 4 according to the invention, more specifically assembled in combination to form a coverage surface. The coverage surface can be used for a building wall, ceiling or a floor. Each of the panels according to the invention respectively has four panel edges F, M, N and U and four corners K1, K2, K3 and K4. As can be seen from the following Figures the panel has a panel top side 7, a panel underside 8 and a panel core 9. The panel has two edge pairs. A first edge pair is shown by way of example in FIG. 2 and includes the panel edges N and F, wherein the panel edge N has a groove profile 5 and the panel edge F has a tongue profile 6. A second edge pair is shown in FIG. 3 and includes the panel edges M and U which are in the form of hook profiles. The panel edge M is in the form of a receiving hook 10 and the panel edge U in the form of an arresting hook 11. The receiving hook 10 is provided with a holding groove 12 for a separate locking element 13. The locking element 13 is fitted and used in such a way that it locks in the vertical direction (vertical locking element). The arresting hook 11 can be connected to the receiving hook 10 by means of a joining movement in a vertical plane downwardly. If a vertical locking element 13 is used the vertically acting locking effect takes place automatically, as is described in detail hereinafter with reference to FIG. 3. By virtue of the two different edge pairs the proposed panel is suitable for locking by a pivotal movement (fold-down). The pivotal movement is indicated in FIG. 2 by reference to the panel 4 which is shown in broken line in an inclined starting position 4'. The panel 4 is moved down from its starting position 4' in the direction of the pivotal arrow S by a single downwardly pivotal movement about its panel edge F as the axis of rotation. In that situation it locks with the groove profile 5 of the panels 1 and 2 of a preceding row of panels P1. At the same time the panel edge U of the panel 4 is locked to the panel edge M of the panel 3 which is in the same row of panels P2.

As shown in FIG. 1 at a corner K1 of the panel 4, the panel edge F (first edge pair) meets the panel edge U (second edge pair). That corner K1 is found to be particularly critical in regard to sealing integrity of the coverage surface in relation to water passing therethrough. At the critical corner K1 the tongue profile 6 of the panel edge F meets the arresting hook 11 of the panel edge U. The cross-sections of the tongue profile 6 and the arresting hook 11 overlap spatially and that affords a complex spatial configuration at the corner K1.

In combination with further identical panels 1 and 3 the corner K1 in question of the panel 4 is disposed in a region marked by IV. There a T-join is formed, composed of a longitudinal join (panel edges F/N) and a transverse join (panel edges M/U). A view on to that T-join in the viewing direction indicated by the arrow IV is described in detail hereinafter with reference to FIG. 4.

Referring to FIG. 2 this shows the first edge pair of the panel according to the invention in cross-section. The direction of view corresponds to the section line II-II shown in FIG. 1. The panel edges F and N of the panels 1 and 4 are opposite in FIG. 2 as indicated in FIG. 1 by means of the section line II-II. The panel edge F has a tongue profile and the panel edge N has a complementary groove profile. Those complementary panel edges F/N can be shown portion-wise in the locked state, as if the panel is divided into two parts. That form of illustration is intended to make it easier to understand the functionality and cooperation of the complementary panel edges. A starting position 4' of the panel edge F indicates a pivotal movement S. It will be appreciated that a plurality of panels of the kind according to the invention can be locked together in the same way to produce a coverage surface for a building wall, a floor or a ceiling. For that reason FIGS. 2 and 3 can also each be viewed as being two panels which are shown portion-wise.

The panel edge M in the form of the receiving hook 10 and the panel edge U in the form of the arresting hook 11 of the second edge pair are shown in cross-section in FIG. 3, more specifically also in the assembled locked state. The direction of view corresponds to the section line shown in FIG. 1.

At the second edge pair the arresting hook 11 of the panel edge M at the panel top side 7 has an edge break in the form of a larger chamfer 36 and the receiving hook 10 of the panel edge U is provided with a smaller chamfer 37.

The smaller chamfer 37 extends over a distal projection 38 arranged distally on the arresting hook 11. An underside of the projection forms a counterpart surface 39 which in the locked state covers over a part of the larger chamfer 36 and is in contact with that part so that this gives a first seal in relation to the ingress of water. In the locked state the two chamfers form a V-shaped join 40.

The receiving hook 10 and the arresting hook 11 lock the assembled panel edges M/U in the vertical and also in the horizontal direction. To give the vertical locking action in this embodiment a separate locking element 13 (vertical locking element) can be fitted into the holding groove 12 in the receiving hook 10, that is provided for that purpose. Provided on the arresting hook 11 is a latching recess 11*a* into which the locking element 13 can latch. The latching recess has an inclined lower groove wall 11*b* and an inclined upper groove wall 11*c*.

The holding groove 12 that is provided in the receiving hook 10 for the locking element 13 is provided with a flat lower groove wall 12*a*, an upper groove wall 12*b* and a groove bottom 12*c*. The upper groove wall 12*b* has a step 12*d* so arranged that there is a narrower part of the holding groove 12 facing towards the groove bottom 12*c* and a region of a greater width, directed towards the open side of the holding groove 12.

The configuration of the holding groove 12 with the step 12*d* is adapted to the known locking element 13, the cross-section of which is shown by way of example in FIG. 3. In the case of the illustrated hatched locking element 13 a latching means 13*a* is provided in the form of an inclinedly downwardly projecting latching tab 13*b* projecting out of the holding groove 12. In addition the locking element 13 includes a holding means 13*c* which faces towards the groove bottom 12*c* of the holding groove 12, and a shoulder 13*d* supported against the step 12*d* of the upper groove wall. Suitable locking elements are known for example from the following publications: EP 1 415 056 B1, WO 2011/087425 A1 and US 2014/0366476 A1.

For the horizontal locking action, as shown in FIG. 3, the receiving hook 10 of the panel edge M is provided distally with a hook edge 41 projecting in the direction of the panel top side 7, and with a receiving recess 42 which is open towards the panel top side 7. The arresting hook 11 of the panel edge U has an arresting step 43 projecting in the direction of the panel underside 8 and a downwardly open arresting recess 44. The arresting step 43 fits into the receiving recess 42 of the receiving hook 10 and cooperates therewith.

The receiving hook 10 has at the hook edge 41 a holding surface 45 directed towards the panel core 9. Equally provided on the arresting hook 11 is a holding surface 46 which is also directed towards the panel core 9 and which with the holding surface 45 on the hook edge 41 affords an undercut configuration and thus provides a locking action to prevent the panels 3 and 4 from moving away from each other within the panel plane in a direction perpendicular to the locked panel edges M/U (horizontally).

In the present example, at a step underside 47, the arresting step 43 has a distal step surface 48 which is in contact with a bottom 49 of the receiving recess 42, and a proximal recess 50 which extends laterally as far as the holding surface 46 of the arresting step 43. The recess 50 uses good contact in respect of the holding surfaces 45/46 of the hook edge 41 and the arresting step 43.

Within the locking configuration shown in FIG. 3 it is also possible to see pairs of contact surfaces, wherein a respective surface of the arresting hook 11 is in contact with an associated surface of the complementary receiving hook 10. In a direction from above downwardly through the locking configuration that begins with a first contact surface pairing which is formed from the counterpart surface 39 of the projection 38 of the arresting hook and the covered part of the larger chamfer 36 which is arranged on the receiving hook 10.

The next contact surface pairing is formed from a butting surface 10*a* and a counterpart butting surface 11*d*. The butting surface 10*a* is provided on the receiving hook 10 with the panel edge M beneath the large chamfer 36 and the counterpart butting surface 11*d* is provided on the arresting hook 11 of the panel edge N below the small chamfer 37. In this arrangement the butting surface 10*a* is arranged perpendicularly relative to the panel top side 7 and the counterpart butting surface 11*d* is inclined relative to the orthogonal to the panel top side 7 through an angle of 3°. In that case provided in an upper part of the counterpart butting surface 11*d* is a material excess which is shown in broken line in FIG. 3 as an oversize E2. In the locked state the oversize E2 leads to a pressure effect between the contact surface pairing comprising the butting surface 10*a*/counterpart butting surface 11*d*, more specifically in the upper half of that contact surface pairing. That pressing action also provides a sealing effect.

As a third contact surface pairing there then follows a pairing consisting of the butting surface 10*a* of the receiving hook 10 and a sealing nose 51 provided at the lower end of the counterpart butting surface 11*d*. The sealing nose 51 extends parallel to the panel edge U over the entire length of the counterpart butting surface 11*d*. In that arrangement the sealing nose 51 projects with an oversize from the counterpart butting surface 11*d* so that in the locked state it bears with a certain pressure against the butting surface 10*a* and provides an additional seal there.

Figure 4:
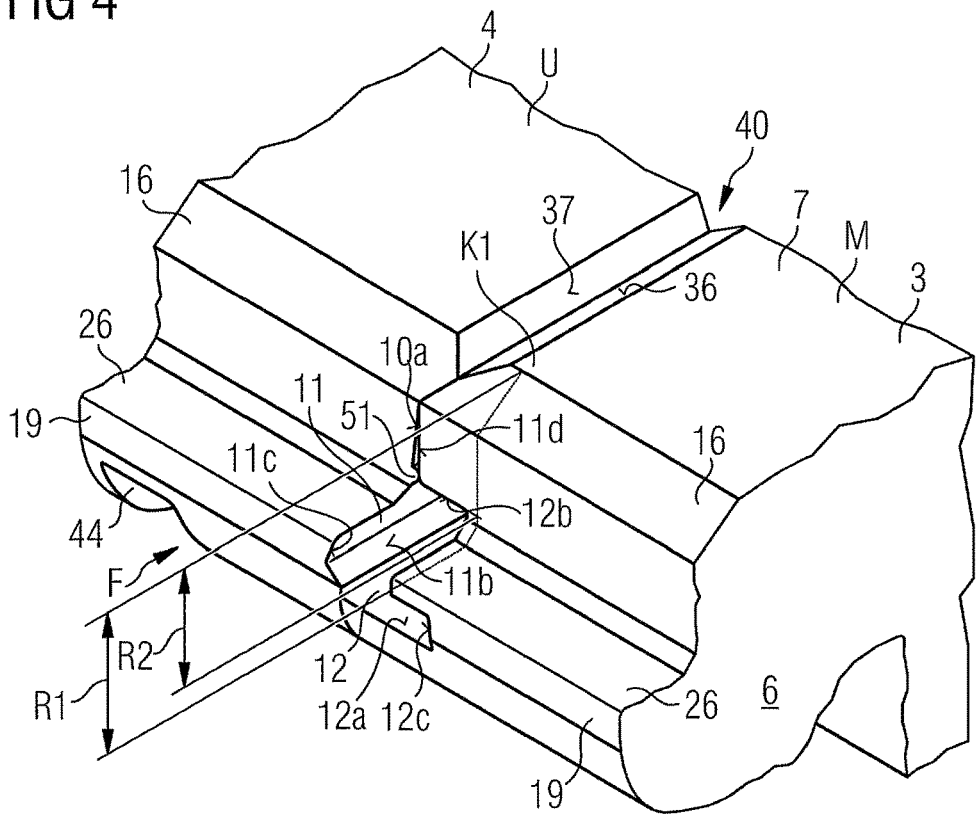
FIG. 4 shows a perspective view of two panel portions having the panel edges of FIG. 2 in the locked state and with the tongue profile shown in FIG. 1.

FIG. 4 shows an isometric view of two connected panels 3 and 4. The view corresponds to the direction of view IV as noted in FIG. 1. In the foreground of FIG. 4 it is possible to see the tongue profiles F of the panels 3 and 4. The panel edge M of the panel 3 and the panel edge U of the panel 4 extend rearwardly in the perspective view. The panel edge M is provided with the receiving hook 10 and the panel edge U is provided with the arresting hook 11 shown in FIG. 3.

In addition FIG. 4 also indicates the critical corner K1 of the panel 3, at which the receiving hook 10 inclusive of the holding groove 12 (panel edge M) provided for the locking element 13 comes together with the tongue profile (panel edge F). The perspective view in FIG. 4 shows that the holding groove 12 extends through the tongue profile and issues at the tip of the tongue. In the region in which the holding groove 12 passes through the tongue profile a part of the tongue top side is also missing. That results in a gap in the tongue top side.

Provided on the complementary panel 4 is the latching recess 11*a* in which the locking element 13 can automatically latch. The latching recess 11*a* also extends on the panel 4 through the tongue profile and ends in the form of an open cross-section at the tongue tip.

The arresting hook 11 (panel edge U) of the panel 4 also includes the downwardly open arresting recess 44 shown in cross-section in FIG. 3. The arresting recess 44 also extends transversely through the tongue profile of the panel 4 and issues in the lower region of the tonge profile. The open cross-section of the arresting recess 44 issues beneath the tongue tip.

Figure 5:
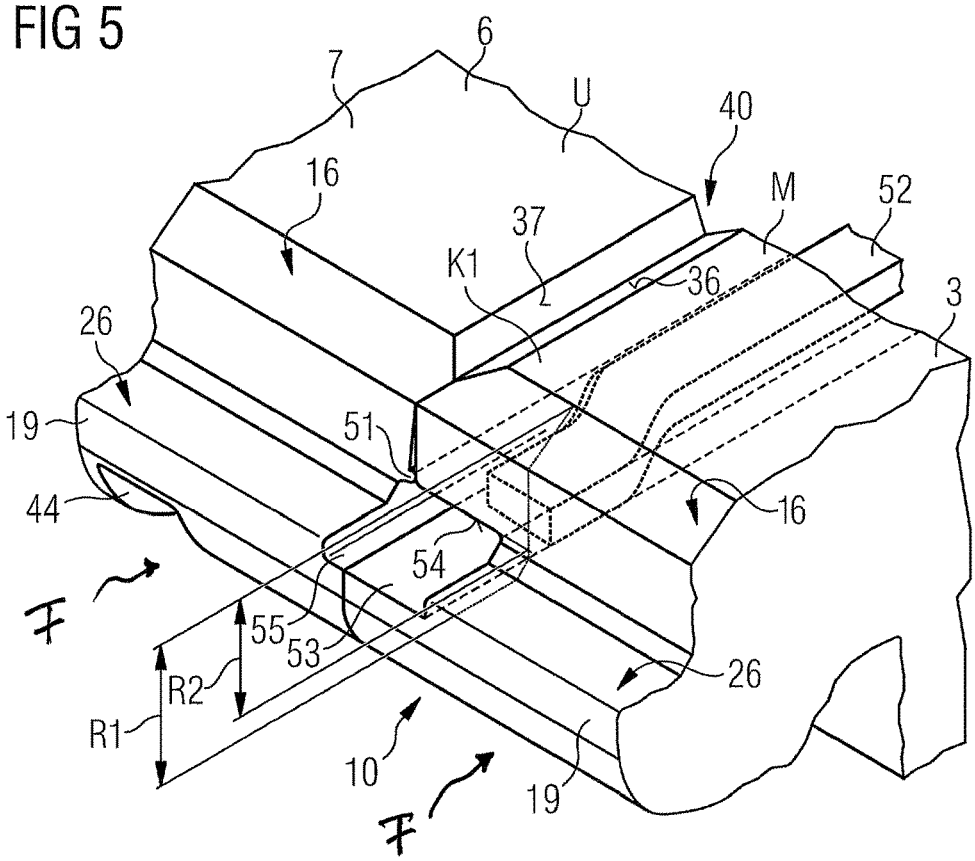
FIG. 5 shows a perspective view of two panel portions in the locked state with an alternative separate locking element.

FIG. 5 shows a perspective view of two panel pieces of an alternative embodiment of the panel. It differs from FIG. 4 because it is designed for an alternative locking element 52. A holding groove 53 of rectangular cross-section is provided for that locking element 52 on the receiving hook 10, wherein the locking element 52 can be pre-fitted into the holding groove. The holding groove 53 has an upper groove wall 54 arranged at a spacing R2 from the panel top side 7. The arresting hook 11 also has a latching contour which is in the form of a locking groove 55 and the cross-section of which is correspondingly adapted so that the locking element 52 can automatically come into latching engagement there. The holding groove 53 proposed in FIG. 5 is adapted for the use of an arcuate locking element 52 as is known from US 2014/0366476 A1 (FIG. 3*b*) or is adapted for a locking element known from the same document with rearward resilient bristles (FIG. 6*a* or FIG. 6*b*) which bear against the bottom of the holding groove 53. What is important is that the tongue top side of the tongue profile of the panel edge F is arranged at a higher level than the upper groove wall 54 of the holding groove 53 of the receiving hook 10. The tongue profile of the panel edge F comes together with the receiving hook 10 at the critical corner K1 of the panel 3. The holding groove 53 extends in the region of the corner K1 through the tongue profile so that the material of the tongue profile is removed. The tongue top side however is not removed. Between the panel top side 7 and the tongue top side there is a spacing R1 which is greater than the spacing R2 between the upper groove wall 54 of the holding groove 53 and the panel top side 7.

Figure 6:
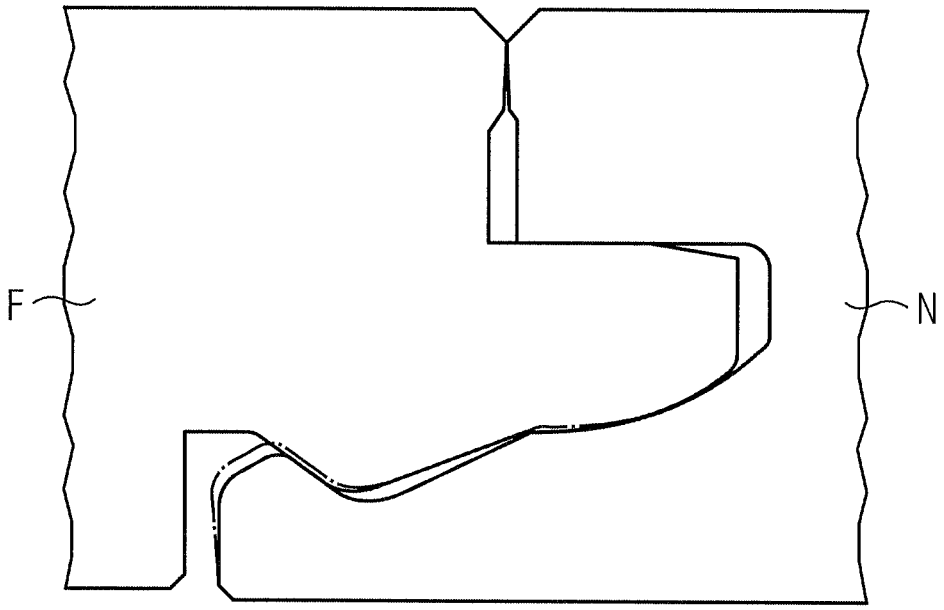
FIG. 6 shows an alternative cross-section through a first edge pair of a panel according to the invention in the locked state.

FIG. 6 shows an alternative cross-section through a first edge pair of a panel according to the invention in the locked state. The panel has a panel edge F with a tongue profile and a panel edge N with a groove profile. The two panel edges F and N are locked in positively locking relationship by the illustrated configuration of the complementary panel edges, more specifically both in the vertical and in the horizontal directions.

Figure 7:
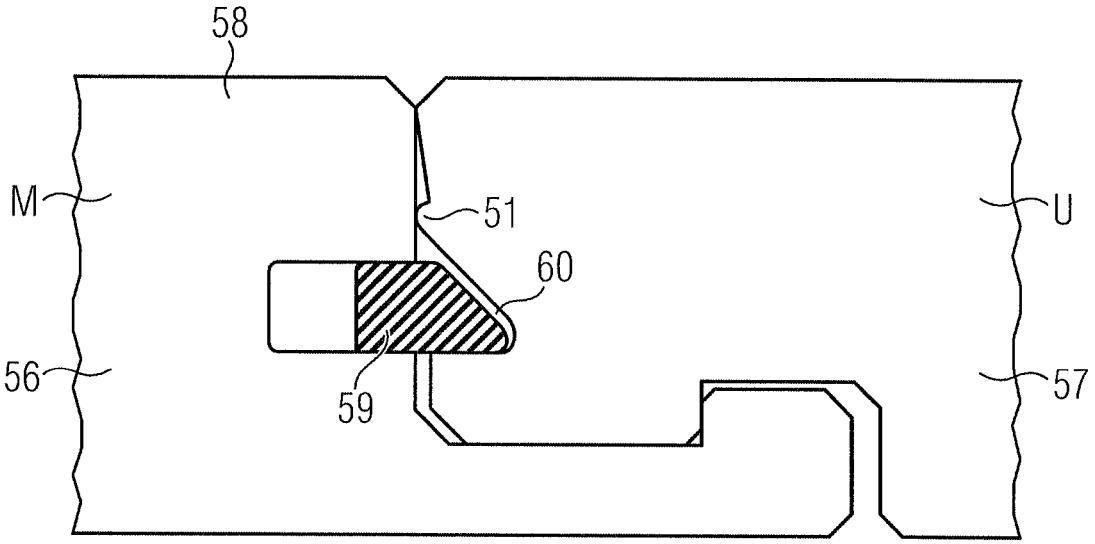
FIG. 7 shows an alternative cross-section through the second edge pair of a panel according to the invention in the locked state.

FIG. 7 shows an alternative cross-section through the second edge pair of the panel according to the invention in the locked state. This example includes a receiving hook 56 at a panel edge M and an arresting hook 57 at a panel edge U. A holding groove 58 for a locking element 59 is provided in the receiving hook. The holding groove 58 has parallel groove walls which are at a constant spacing from each other. The arresting hook 57 has a contour 60, into which the locking element 59 can automatically latch during a joining movement. The holding groove 58 for the locking element 59 is arranged substantially parallel to the panel top side 7. Provided on the arresting hook 57 is a sealing nose 51 which is in contact with the receiving hook 56. The contact takes place directly above and near to the holding groove 58 of the receiving hook 56.

Figure 8:
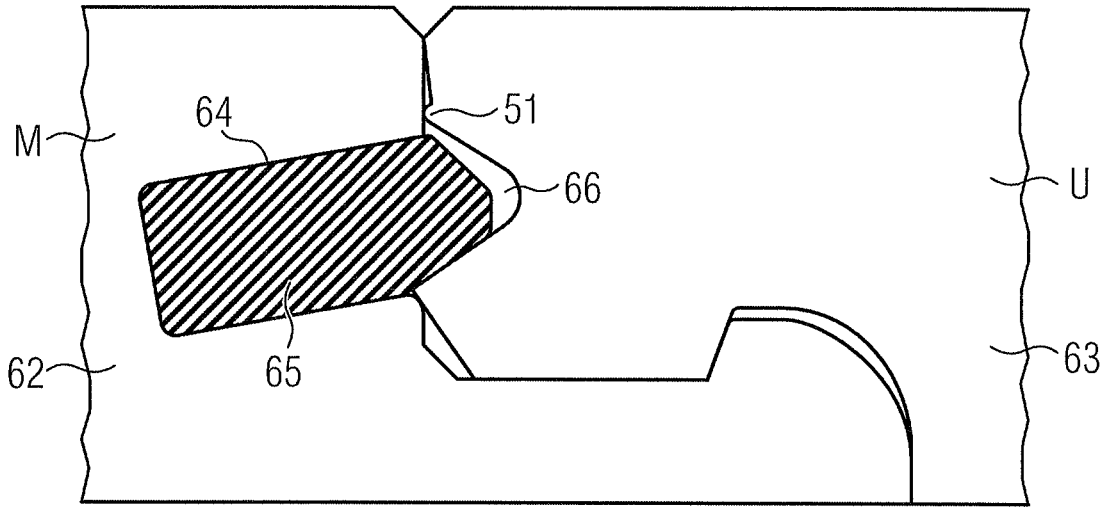
FIG. 8 shows a further example of a cross-section through a second edge pair of the panel according to the invention in the locked state.

FIG. 8 shows a further example of a second edge pair. Once again there is a receiving hook 62 on a panel edge M and an arresting hook 63 on a panel edge U.

The receiving hook 62 includes a holding groove 64 for a locking element 65, the holding groove 64 having parallel groove walls which are at a constant spacing relative to each other. The arresting hook has a contour 66 in which the locking element 65 can automatically latch during a joining movement. As a difference in relation to the FIG. 7 example here the holding groove 64 is arranged inclinedly in the receiving hook 62 relative to the panel top side 7. The free opening of the inclined holding groove 64 is directed upwardly in the direction of the panel top side. Provided on the arresting hook 63 is a sealing nose 51 which is in contact with the receiving hook 62. The contact takes place directly above and near to the holding groove 64 of the receiving hook 62.

Figure 9:
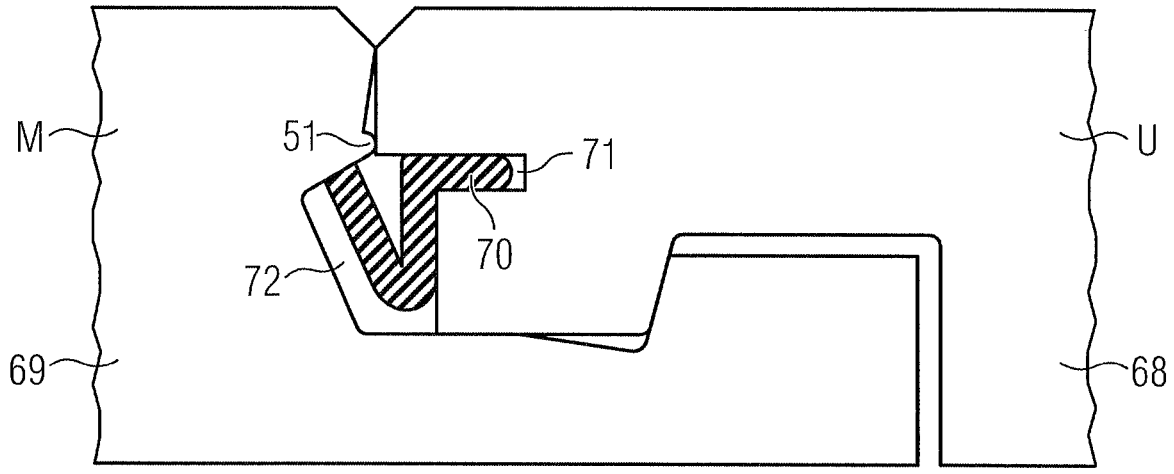
FIG. 9 shows yet another example of a cross-section through the second edge pair of the panel according to the invention in the locked state.

FIG. 9 shows yet another example of a cross-section through the second edge pair of the panel according to the invention in the locked state. That example also has a receiving hook 68 at a panel edge M and an arresting hook 69 at a panel edge U, which can be automatically locked in the vertical direction by means of a locking element 70. In this example there is a holding groove 71 for the locking element 70 but on the arresting hook 69 and the receiving hook 68 has a contour 72, into which the locking element 70 can automatically latch. This arrangement has a sealing nose 51 on the receiving hook 69 and the sealing nose 51 is in contact with the arresting hook 68. Contact occurs directly above and near the holding groove 71 of the arresting hook 68.

FIG. 10 shows a last example of a cross-section through the second edge pair. This example again has a receiving hook 74 and an arresting hook 75 which can be locked automatically in the vertical direction by means of a locking element 76. As in FIG. 9 in this example too there is a holding groove 77 for the locking element 76 on the arresting hook 75. The holding groove 77 has parallel groove walls which are at a constant spacing relative to each other. The receiving hook 74 has a contour 78 into which the locking element 76 can automatically latch. Here a sealing nose 51 is also provided on the receiving hook 74 and the sealing nose 51 is in contact with the arresting hook 75. The contact occurs directly above and near the holding groove 77 of the arresting hook 75.

FIG. 11 concerns the portion marked by XI in FIG. 10. FIG. 11 enlarges that portion on the one hand and in addition for the sake of simplicity shows only one of two hook profiles, namely the receiving hook 74. The locking element has also been omitted in FIG. 11 for the sake of simplicity. It is possible to see the sealing nose 51 which at that panel edge projects in a distal direction from the butting surface of the receiving hook 74. The cross-section of the sealing nose 51 desirably involves an outside contour comprising combined rounded and curved portions. The distal end of the sealing nose 51 has a turning point or a turning point tangent T. The turning point tangent T is applied at the turning point which is distally remote at the maximum from the panel core and in this example it is arranged at an angle of 90° relative to the panel top side 7.

LIST OF REFERENCES

1 panel
2 panel
3 panel
4 panel
4' starting position
6 tongue profile
7 panel top side
8 panel underside
9 panel core
10 receiving hook
10*a* butting surface
11 arresting hook
11*a* latching recess
11*b* lower groove wall
11*c* upper groove wall
12 holding groove
12*a* lower groove wall
12*b* upper groove wall
12*c* groove bottom
12*d* step
13 locking element
13*a* latching means
13*b* latching tab
13*c* holding means

13*d* shoulder
36 larger chamfer
37 smaller chamfer
38 projection
39 counterpart surface
40 V-join
41 hook edge
42 receiving recess
43 arresting step
44 arresting recess
45 holding surface (hook edge)
46 holding surface (arresting hook)
47 step underside
48 distal step surface
49 bottom
50 recess
51 sealing nose
52 locking element
53 holding groove
54 upper groove wall
55 locking groove
56 receiving hook
57 arresting hook
58 holding groove
59 locking element
60 contour
62 receiving hook
63 arresting hook
64 holding groove
65 locking element
66 contour
68 receiving hook
69 arresting hook
70 locking element
71 holding groove
72 contour
74 receiving hook
75 arresting hook
76 locking element
77 holding groove
78 contour
D spacing
E1 oversize
E7 oversize
F panel edge (tongue)
H height
K1 corner
K2 corner
K3 corner
K4 corner
L panel edge (groove)
M panel edge (receiving hook)
P1 row of panels
P2 row of panels
U panel edge (arresting hook)
S pivotal movement

The invention claimed is:

1. A panel comprising a panel core, a panel top side, a panel underside and a first edge pair and a second edge pair, wherein the first edge pair is provided with a groove profile at a first panel edge and a tongue profile complementary thereto at a second panel edge that is opposite the first panel edge, which are lockable by a pivotal movement and then cooperate in a positively locking relationship in such a way that in a locked state a vertical locking action can be achieved and movement of the panel and an adjacent panel away from each other in a horizontal plane of the panels is opposed, wherein the second edge pair is provided on another pair of opposite panel edges, made up of a third panel edge and a fourth panel edge opposite the third panel edge, and has complementary hook profiles, namely a receiving hook and an arresting hook, wherein the arresting hook is joinable to the receiving hook by a joining movement in a plane perpendicular to the panel plane simultaneously with the pivotal movement for the first edge pair, wherein the receiving hook is provided with a holding groove or the arresting hook is provided with a holding groove for a separate locking element with which a vertical locking action is achieved, wherein a butting surface is arranged at the receiving hook substantially orthogonally relative to the panel top side, wherein a counterpart butting surface is arranged at the arresting hook substantially orthogonally relative to the panel top side, wherein there is provided at least one sealing nose at the second edge pair at a lower end of the counterpart butting surface of the arresting hook and above the separate locking element in the locked state, wherein the sealing nose has an upper side and a lower sider that extend in a distal direction and the sealing nose is parallel to the third panel edge or the fourth panel edge over the entire length of the counterpart butting surface.

2. The panel according to claim 1, wherein each edge of at least one of the edge pairs has a respective edge break which forms a recessed contact in the assembled state of two of said panels.

3. The panel according to claim 2, wherein the edge breaks of the at least one of the edge pairs are respectively a larger edge break and a smaller edge break and in the assembled state the larger edge break is covered over by the smaller edge break.

4. The panel according to claim 3, wherein the panel edge with the smaller edge break has a projection with a top side that forms at least a part of the smaller edge break, and provided at an underside of the projection is an undercut counterpart surface that contacts a covered-over part of the larger edge break so as to form a seal against water ingress.

5. The panel according to claim 3, wherein each edge of both of the edge pairs has an edge break where the edge breaks of each edge pair include a smaller edge break and a larger edge break, wherein the smaller edge break of the first edge pair is arranged at the groove profile and the larger edge break is arranged at the tongue profile and the smaller edge break of the second edge pair is arranged at the arresting hook and the larger edge break is arranged at the receiving hook.

6. The panel according to claim 1, wherein at the second edge pair the counterpart butting surface or the butting surface is inclined relative to orthogonal to the panel top side by an angle in a range of 1°-5°, wherein a cross-section of the arresting hook is dimensioned in a region of the inclined counterpart butting surface or the butting surface so that in the locked state a pressing action is caused between the counterpart butting surface and the butting surface.

7. The panel according to claim 6, wherein the pressing action between the counterpart butting surface and the butting surface is greater at an upper end of the butting surface and decreases towards a lower end of the butting surface.

8. The panel according to claim 7, wherein the sealing nose is arranged at a vertically lower region of the pressing action between the counterpart butting surface and the butting surface.

9. The panel according to claim 1, wherein the separate locking element has a latching means with which it is latchable in a latching recess in an opposed edge of the second edge pair.

10. The panel according to claim 1, wherein the holding groove for the separate locking element has parallel groove walls.

* * * * *